US008365338B1

(12) United States Patent
Figaro

(10) Patent No.: US 8,365,338 B1
(45) Date of Patent: Feb. 5, 2013

(54) WHEEL CLEANING DEVICE

(76) Inventor: Cedric Figaro, Westwego, LA (US)

( * ) Notice: Subject to any disclaimer, the term of this patent is extended or adjusted under 35 U.S.C. 154(b) by 92 days.

(21) Appl. No.: 13/024,554

(22) Filed: Feb. 10, 2011

(51) Int. Cl.
*A46B 5/00* (2006.01)

(52) U.S. Cl. ..... 15/160; 15/164; 15/206

(58) Field of Classification Search ..... 15/160, 15/145, 164, 206
See application file for complete search history.

(56) References Cited

U.S. PATENT DOCUMENTS 4,117,566 A 10/1978 Ward
4,120,068 A 10/1978 Kaczmarek
5,067,194 A * 11/1991 Rosenfeld et al. ..... 15/144.2
7,631,385 B2 12/2009 Schouten
7,971,310 B2 * 7/2011 Metaxatos et al. ..... 15/105
D647,703 S * 11/2011 Li ..... D4/128

* cited by examiner

*Primary Examiner* — Shay Karls

(57) ABSTRACT

The wheel cleaning device is especially useful in cleaning lug nuts and the area and orifice within a wheel that surround a lug nut. The device may importantly provide for brush change, via a threaded fitting. Various bristle designs are provided. The device also importantly provides an arc within the shaft so that the brush can be inserted beyond a bulbous exterior of many typical lug nuts. The arc then allows a user to clean the area without device failure and without undue brush bristle fatigue, as the arc allows clearance adjacent to the most bulbous part of a lug nut so that the brush may better reach the confines of the spaces typically not reached. The cylindrically shaped handle may be provided with a rounded end as a more user friendly interface.

2 Claims, 3 Drawing Sheets

WHEEL CLEANING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Proper auto wheel cleaning remains a chore, even with the variety of devices now offered to assist. A clear challenge remains to equipment and users in the area of lug nuts and lug orifices. The brushes and sponges currently offered in an attempt to assist cleaning in this lug nut and orifice area are not adequate due to several reasons. Devices are available to surround the lugs and to be forced into the orifice area, but such devices are not meant to accommodate the tight confines therein. Bristles fail. Sponge type devices are typically insufficiently rigid to invade such areas. Additionally, few devices provide changeable bristles or sponges such that failure of either is tantamount to complete device failure. The present wheel cleaning device solves these problems.

FIELD OF THE INVENTION

The wheel cleaning device relates to auto and auto wheel detail tools and more especially to a wheel cleaning device especially suited to cleaning lug nuts and the surrounding orifices associated with same, within a wheel.

SUMMARY OF THE INVENTION

The general purpose of the wheel cleaning device, described subsequently in greater detail, is to provide a wheel cleaning device which has many novel features that result in an improved wheel cleaning device which is not anticipated, rendered obvious, suggested, or even implied by prior art, either alone or in combination thereof.

To attain this, the wheel cleaning device, while useful in detailing several areas of an auto or other equipment, is especially useful in cleaning lug nuts and the area and orifice within a wheel that surround a lug nut. The device may importantly provide for brush change, via a threaded fitting. Various bristle designs are provided. The device also importantly provides an arc within the shaft so that the brush can be inserted beyond a bulbous exterior of many typical lug nuts. The arc then allows a user to clean the area without device failure and without undue brush bristle fatigue, as the arc allows clearance adjacent to the most bulbous part of a lug nut so that the brush may better reach the confines of the spaces typically not reached. The cylindrically shaped handle may be provided with a rounded end as a more user friendly interface.

The size of the device may vary, yet a preferred embodiment may offer a size critical to function, with an overall length of about 6½ inches, a cylindrically shaped handle length of about 2 inches, and a total shaft length of about 3½ inches. Further, brush lengths may vary and thereby alter the overall length. Brush lengths vary to accommodate various lug and orifice depth and size. The brush may extend to a round brush end as illustrated. Brushes may also be provided in different shapes to adapt to correctly clean various lug and orifice features.

Thus has been broadly outlined the more important features of the improved wheel cleaning device so that the detailed description thereof that follows may be better understood and in order that the present contribution to the art may be better appreciated.

An object of the wheel cleaning device is to assist in detail cleaning various objects.

Another object of the wheel cleaning device is to be especially useful in cleaning an auto lug nut and the wheel area surrounding the lug nut.

A further object of the wheel cleaning device is to provide a plurality of interchangeable, varied brushes.

An added object of the wheel cleaning device is to provide a user friendly cylindrically shaped handle.

These together with additional objects, features and advantages of the improved wheel cleaning device will be readily apparent to those of ordinary skill in the art upon reading the following detailed description of presently preferred, but nonetheless illustrative, embodiments of the improved wheel cleaning device when taken in conjunction with the accompanying drawings.

DETAILED DESCRIPTION OF THE DRAWINGS

With reference now to the drawings, and in particular FIGS. 1 through 5 thereof, the principles and concepts of the wheel cleaning device generally designated by the reference number 10 will be described.

Figure 4:
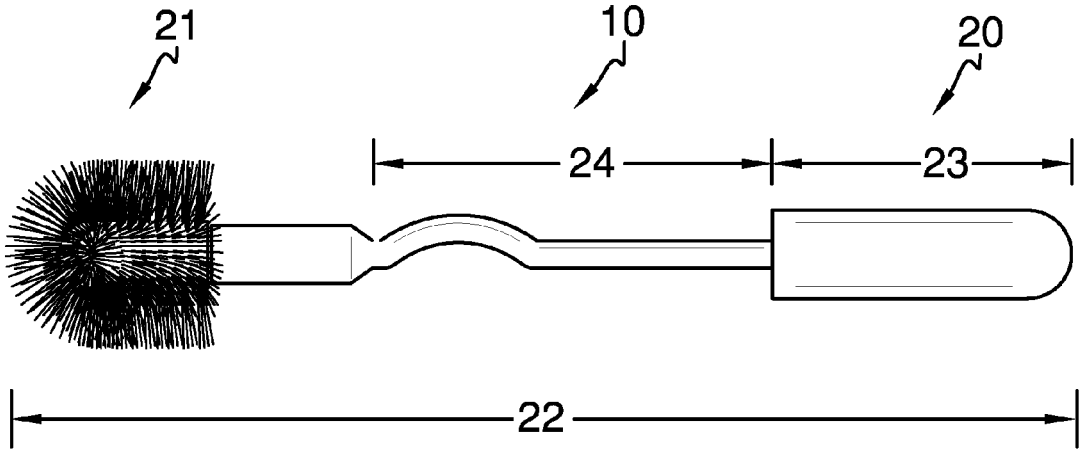
FIG. 4 is a lateral elevation view.

Referring to FIG. 4, the device 10 partially comprises a first end 20 spaced apart from a second end 21.

The cylindrically shaped handle 37 is disposed at the first end 20. A rounded end 38 is disposed on the cylindrically shaped handle 37 first end 20. The flat end 39 is disposed adjacent at the shaft 30.

Figure 1:
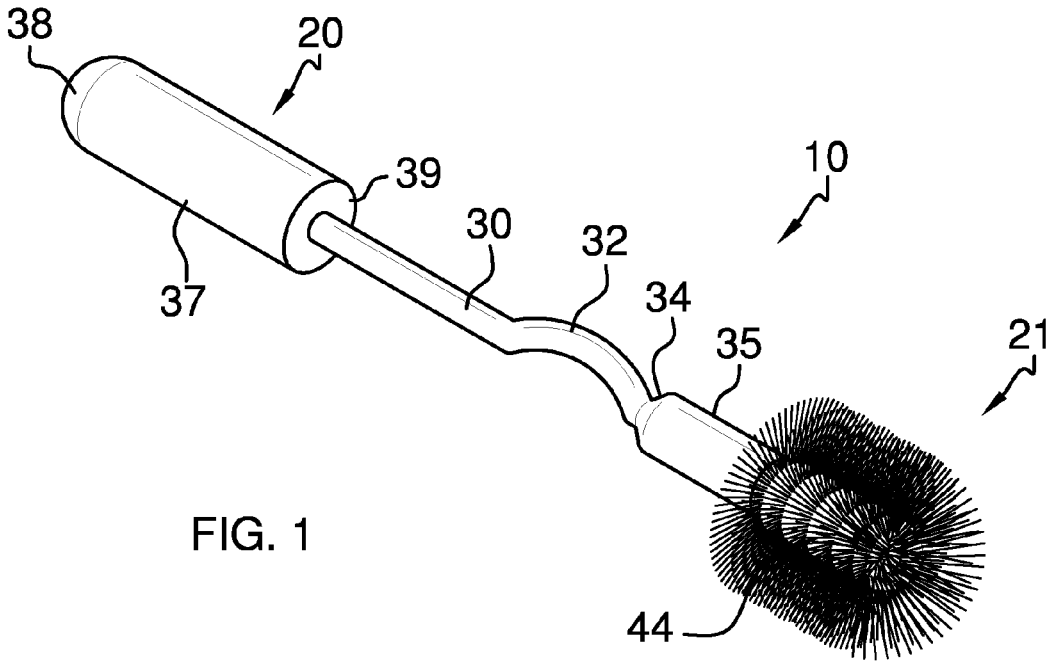
FIG. 1 is a second end perspective view.

Referring to FIG. 1, the shaft 30 is extended from the cylindrically shaped handle 37.

Figure 2:
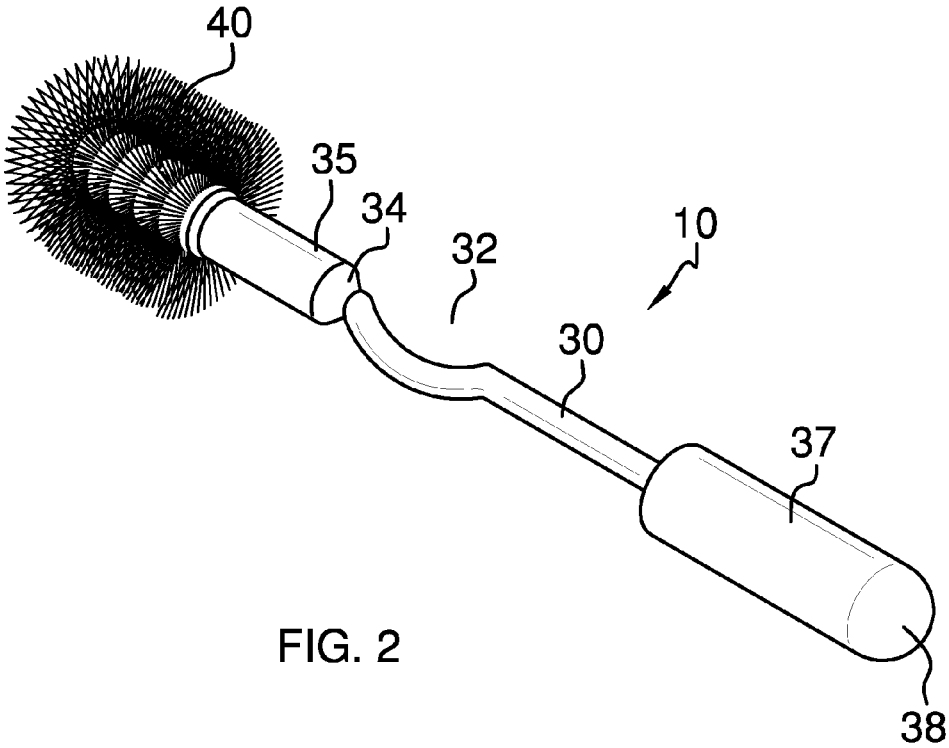
FIG. 2 is a first end perspective view.

Referring to FIG. 2, the sleeve 35 is disposed on the shaft 30 second end 21. The bevel 34 connects the sleeve 35 to the shaft 30.

Referring again to FIG. 4, the arc 32 is disposed in the shaft 30 immediately adjacent to the bevel 34. The bevel 34 establishes a smooth transition to the sleeve 35 so that wheel 12 surfaces are not faced with an abrupt edge and so that the shaft 30-to-sleeve 35 connection is a strong one.

Again referring to FIG. 4, the device 10 comprises a length 22 of about 6½ inches, a cylindrically shaped handle length 23 of about 2 inches, and a shaft length 24 of about 3½ inches.

Figure 3:
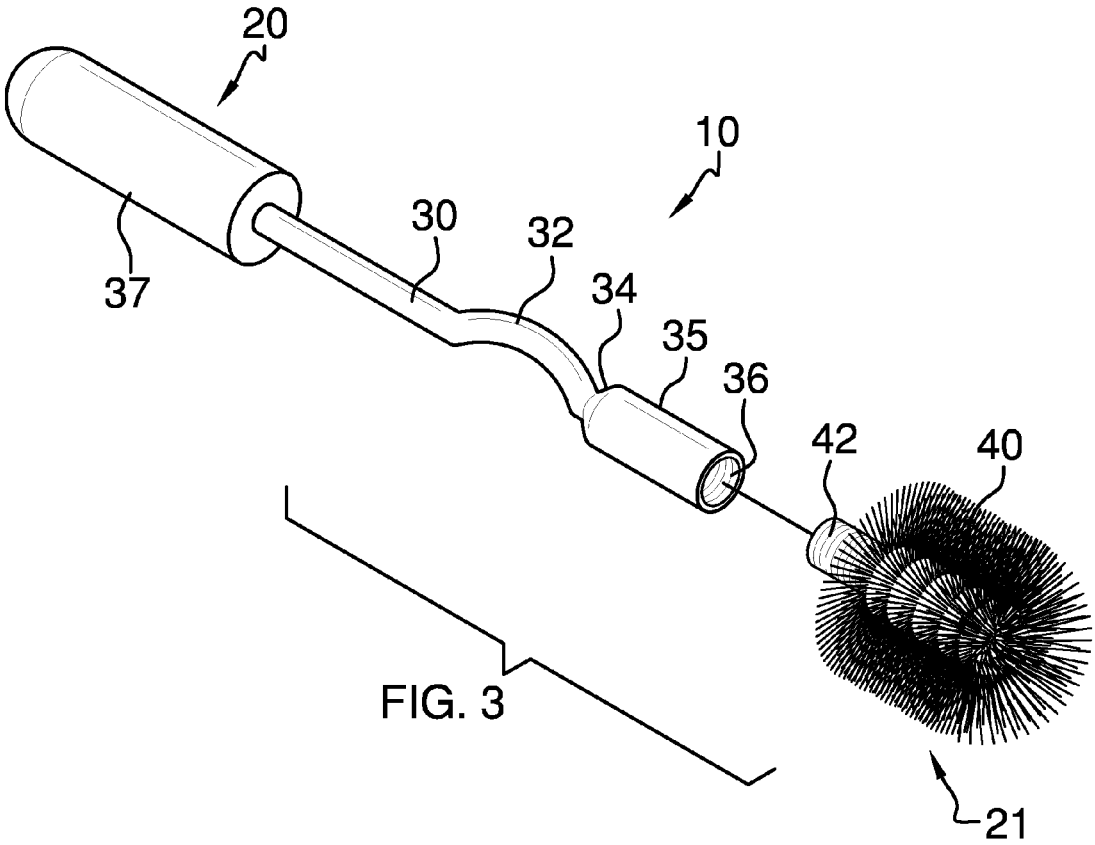
FIG. 3 is a second end perspective view, brush removed.

Referring to FIG. 3, a female thread 36 is disposed in the sleeve 35 second end 21. An interchangeable brush 40 is releasably attachable to the second end 21, said brush 40 disposed along a common longitudinal axis as the handle 37. The brush 40 has a plurality of bristles 44. Bristles 44 are provided in various materials including but not limited to nylon, brass, stainless steel, and natural bristles. The male thread 42 is extended from the brush 40. The male thread 42 is removably fitted within the sleeve 35 female thread 36.

Figure 5:
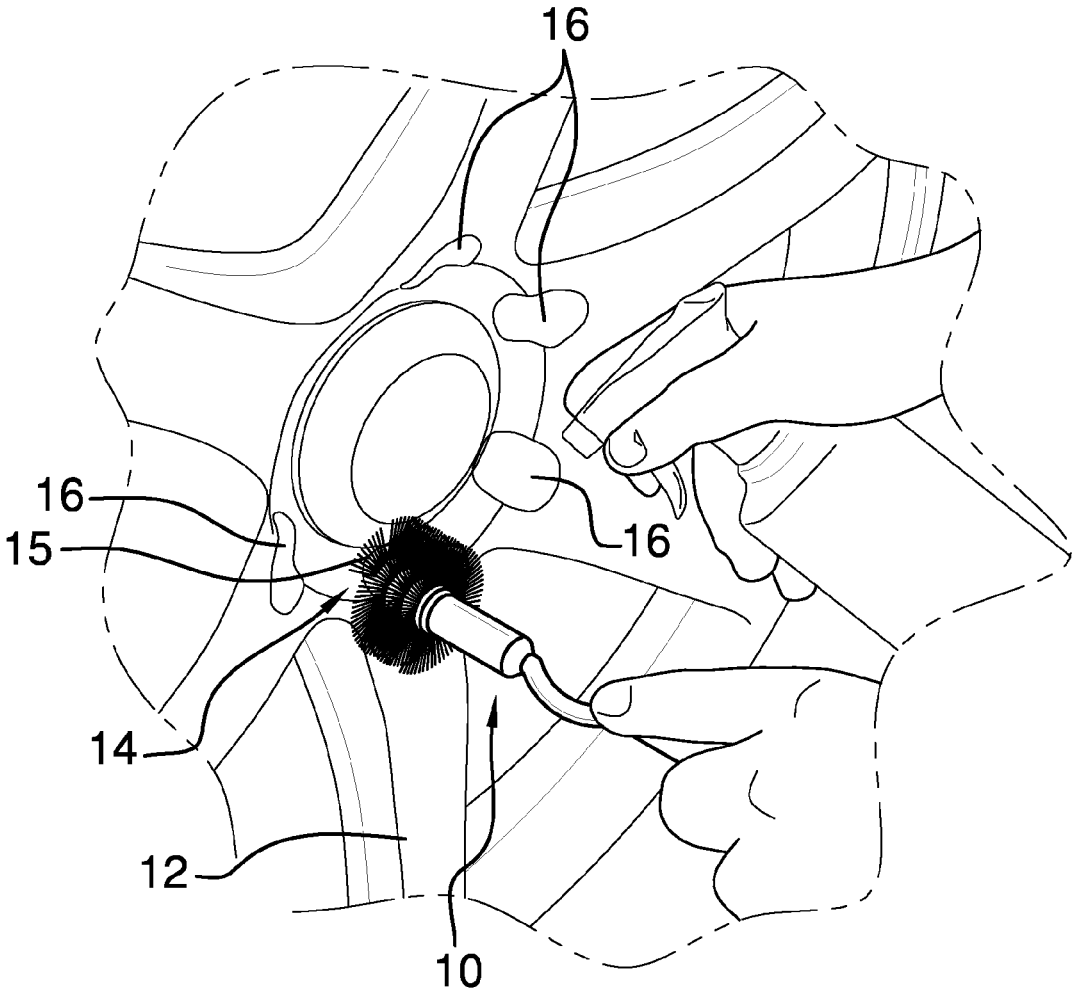
FIG. 5 is a perspective in-use view.

Referring to FIG. 5, various cleaners 16 may be used with the device 10. Typically, a cleaner 16 may be applied to the wheel 12, the brush 40, or even both the wheel 12 and brush 40.

The brush 40 is then inserted into the orifice 15 surrounding the lug 14 and manipulated as is desired to best clean those components of the wheel 12. The cylindrically shaped handle 37 rounded end 38 provides comfort to a user's hand.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the wheel cleaning device may be used.

What is claimed is:

1. A wheel cleaning device comprising, in combination:

a first end spaced apart from a second end;

a handle disposed at the first end;

a rounded end disposed on the handle at the first end;

a shaft extended from the handle;

a flat end disposed upon the handle at the shaft;

a sleeve disposed on the shaft at the second end;

a bevel connecting the sleeve to the shaft;

an arc disposed in the shaft immediately adjacent to the bevel;

a female thread disposed in the sleeve at the second end;

a brush having a plurality of bristles, said brush disposed endwise upon the shaft along a common longitudinal axis as the handle;

a male thread extended from the brush, the male thread removably fitted within the sleeve female thread.

2. A wheel cleaning device comprising, in combination:

a first end spaced apart from a second end, an overall length of about 6½ inches, a cylindrically shaped handle length of about 2 inches, and a total shaft length of about 3½ inches;

a cylindrically shaped handle disposed at the first end;

a rounded end disposed on the cylindrically shaped handle at the first end;

a shaft extended from the cylindrically shaped handle;

a sleeve disposed on the shaft at the second end;

a bevel connecting the sleeve to the shaft;

an arc disposed in the shaft immediately adjacent to the bevel;

a female thread disposed in the sleeve at the second end;

a brush having a plurality of bristles, said brush disposed endwise upon the shaft along a common longitudinal axis as the handle;

a male thread extended from the brush, the male thread removably fitted within the sleeve female thread.

* * * * *